US010415251B1

(12) United States Patent
Gopalan

(10) Patent No.: US 10,415,251 B1
(45) Date of Patent: Sep. 17, 2019

(54) SKYLIGHT WITH COMPOUND PARABOLIC DIFFUSERS

(71) Applicant: Ramesh Gopalan, Fremont, CA (US)

(72) Inventor: Ramesh Gopalan, Fremont, CA (US)

(73) Assignee: Ramesh Gopalan, Fremont, CA (US)

( * ) Notice: Subject to any disclaimer, the term of this patent is extended or adjusted under 35 U.S.C. 154(b) by 0 days.

(21) Appl. No.: 16/403,030

(22) Filed: May 3, 2019

Related U.S. Application Data

(63) Continuation of application No. 15/846,174, filed on Dec. 18, 2017.

(51) Int. Cl.
*E04D 13/03* (2006.01)

(52) U.S. Cl.
CPC ..... *E04D 13/033* (2013.01)

(58) Field of Classification Search
None
See application file for complete search history.

(56) References Cited

U.S. PATENT DOCUMENTS 2,858,734 A * 11/1958 Boyd ..... E04D 3/06 292/256.6
3,307,303 A * 3/1967 Bloxsom ..... E04D 13/03 220/88.1
3,350,556 A * 10/1967 Franck ..... F21S 8/086 362/309
4,519,675 A * 5/1985 Bar-Yonah ..... F21V 5/02 359/595
6,104,854 A * 8/2000 Masaki ..... G02B 6/0053 349/62
6,256,947 B1 * 7/2001 Grubb ..... E04B 9/32 52/17
6,299,317 B1 * 10/2001 Gorthala ..... F21S 11/00 359/853
7,146,768 B2 * 12/2006 Rillie ..... E04D 13/033 52/200
7,322,156 B1 * 1/2008 Rillie ..... E04D 13/033 359/592
7,395,636 B2 * 7/2008 Blomberg ..... E04D 13/03 359/591
7,546,709 B2 6/2009 Jaster et al.
8,132,375 B2 * 3/2012 Jaster ..... E04D 13/033 359/591
8,745,938 B2 6/2014 Schuetz et al.
8,797,652 B2 * 8/2014 Mosher ..... G02B 26/0808 359/619
8,837,048 B2 * 9/2014 Jaster ..... G02B 17/00 359/592
8,982,467 B2 * 3/2015 Jaster ..... F21S 11/00 359/592

(Continued)

OTHER PUBLICATIONS

Radiative Transfer—S. Chandrasekhar—Dover 1960.
High Collection Non-Imaging Optics—W.T. Welford & R. Winston (Academic Press, New York, 1989)].

*Primary Examiner* — Brian E Glessner
*Assistant Examiner* — Adam G Barlow

(57) ABSTRACT

A skylight to provide daylighting is described that includes a plurality of compound parabolic diffusers into one or more layers that may be dome or pyramid-shaped to enable more efficient collection of sunlight and its distribution through wider angles resulting in more comfortable illumination with less glare and heat gain—more light less heat—over wider areas of building interiors.

8 Claims, 7 Drawing Sheets

(56) References Cited

U.S. PATENT DOCUMENTS

| | | | | |
|---|---|---|---|---|
| 9,145,686 | B2 * | 9/2015 | Fooks | E04D 13/033 |
| 9,322,178 | B2 * | 4/2016 | Kastner | E04B 7/18 |
| 9,816,675 | B2 * | 11/2017 | Jaster | F21S 11/002 |
| 9,816,676 | B2 * | 11/2017 | Jaster | F21S 11/007 |
| 2005/0081909 | A1 * | 4/2005 | Paull | H01L 31/052 136/246 |
| 2006/0203490 | A1 * | 9/2006 | Saccomanno | F21V 5/002 362/257 |
| 2007/0074468 | A1 * | 4/2007 | Jaster | E04D 13/03 52/200 |
| 2011/0289870 | A1 * | 12/2011 | Nemazi | E04C 1/42 52/200 |
| 2014/0026501 | A1 * | 1/2014 | Schuetz | E04D 13/033 52/200 |
| 2015/0000197 | A1 * | 1/2015 | Whitehead | E04D 13/035 49/64 |
| 2016/0153194 | A1 * | 6/2016 | Kristensen | E04D 13/033 52/200 |
| 2017/0146204 | A1 | 5/2017 | DiTrapani et al. | |

* cited by examiner

SKYLIGHT WITH COMPOUND PARABOLIC DIFFUSERS

CROSS-REFERENCE TO RELATED APPLICATIONS

This is a continuation of application Ser. No. 15/846,174 filed 2017 Dec. 12, titled 'Skylight' and naming Ramesh Gopalan as inventor.

BACKGROUND OF THE INVENTION

Technical Field

This invention pertains to skylights designed to provide daylighting to interiors of buildings and other enclosed spaces.

About one quarter of all electricity use in the U.S. is for lighting in buildings. The typical unit of lighting is lux or lumens per square meter. A lumen is a candela (cd) of visible light spread into one steradian solid angle, where one candela is about the light from a common wax candle. The indoor lighting need at floor level in homes or offices is about 500-1000 lux or lumens per square meter as provided from above or overhead, this amount of light being available from oblique sun angles outdoors at sunrise or sunset. The sun's rays are always incident in a very small range of solid angle so sunlight when incident from directly overhead at noon on a clear day can provide up to 100000 lux—this is far more than is preferred for comfortable illumination of areas of human occupancy, and this abundance of outdoor light is simply absorbed and felt as uncomfortable heat.

Skylights reduce indoor lighting cost by providing daylighting to homes and offices but when installed on commercial roofs for instance they are typically limited to cover less than 5% of the roof area, since to add more also increases solar heat load to the building interior. Most of the available solar power, up to 1000 Watts per square meter, is then wastefully absorbed as heat in building exteriors, with artificial lighting turned on inside for much of the day. Since cooling and ventilation costs are about 20% of such building energy usage the current tradeoff is between savings in lighting and HVAC costs.

The main challenge for designing efficient skylights is then to maximize the light provided over a wider angle to the widest floor area below while minimizing heat gain to the building. In common terminology, this is to maximize visual light transmittance—VLT (or VT) of the skylight while minimizing the fraction of the sun's energy incident on the skylight that is absorbed as heat in the building interior, typically characterized by the solar heat gain coefficient—SHGC.

Sunlight is incident as an intense beam of nearly parallel rays, with small angular spread of only about 0.50. The area of an opening or aperture which intercepts a beam of solar rays is proportional to the cosine of the angle of incidence and therefore the solar power per unit area is maximum at normal incidence (0) and minimized at oblique angles. This amount of solar radiation per unit area affects how much is seen as comfortable illumination versus how much is absorbed as uncomfortable heat. This is why noontime in summer, when the sun is high up in the sky, feels hotter than when the same sun is lower in the sky during a spring or winter afternoon. Light from a spring afternoon sun is not optimal because, not coming from directly overhead, it can cause uncomfortable glare to eyes. The ideal skylight must combine the optimal aspects of a summer noon sun—daylight provided from overhead with no glare into eyes—with the comfort of a spring afternoon provided with sunlight rays distributed over wider angle over a wider area. To maximize daylighting for comfortable building illumination while minimizing solar heat gain from intense glare of direct sunlight the ideal skylight must collect as much light as possible from all overhead or oblique angles of the sun but always directing the light directly downwards, as if from overhead, into a gently diverging or distributed beam to a wide area below.

As is well known, the sun's daily path across the sky from the eastern to the western horizon also shifts with the yearly seasons. At equinox-March or September—the sun's track is tilted from zenith (directly overhead) at a solar altitude angle equal to the local latitude (38° towards the south in San Francisco, for example). Over the seasons, this sun's daily arc shifts±23.5° about the equinox track, from south in December to north in June. To maximize visual light transmittance and minimize solar heat gain—more light with less heat—the ideal skylight must not only collect light efficiently from the low angles of a winter morning but also spread out over a wider floor area the more intense sunlight of a summer noon.

Description of Related Art

The field of daylighting has seen a number of advances since the earliest relevant patent for a skylight U.S. Pat. No. 2,858,734 was issued to Boyd (1958). Current skylights, such as the pyramid or dome shapes from U.S. suppliers such SunOptics or tubular skylights, for example U.S. Pat. No. 7,546,709 & U.S. Pat. No. 8,132,375 assigned to Solatube include refracting prisms in the entrance aperture of the skylight. Such skylights are designed as a compromise: they admit more light from the sun at oblique angles such as during early or late in the day, or in winter, with less light being allowed in from high angles of the sun as during mid-day in summer. This avoids a narrow, intense light beam and heat from the sun when it is high in the sky but also means that up to 50% of the available light is lost through total internal reflection (TIR) from the lower surface of the prisms. Sunlight enters through the first entrance surface or top surface of the skylight and exits, after refraction (or total internal reflection) through such prisms, through a second or bottom surface of the skylight. In refraction, light is deflected according to Snell's law by an angle $\sin\gamma = n \sin\gamma'$ where $\gamma'$ is the angle to the normal in the medium with refractive index n. For materials like glass, acrylic or polycarbonate plastics n is around 1.5, which means that for sufficiently small angles, 30° for instance, are deflected to about 20°, or by about one-third. However, this deflection is reversed when the refracted ray is transmitted from the refracting medium back into air, so there is no net deflection of the ray unless the second exiting surface is at an (acute) angle relative to the first entrance surface. This angle cannot exceed ~45' (the critical angle at refractive index of 1.5 is about 42°) to avoid total internal reflection TIR; since the seasonal variation of the sun's altitude angle is around 47°, the daily variation being even larger, this means that much of incident sunlight is not collected or optimally distributed through skylights using refractive prisms. This limitation of skylights with refracting prisms applies even when the lower surface of the prisms is curved, with varying slope, to enable a divergence of angles in the light beam transmitted to the building floor below. Therefore, such skylights are not optimized to admitting light when it is most abundant instead only providing a surface for undesirable heat transfer from the hotter air outside, increasing cooling costs.

Optical structures such as compound parabolic concentrators, or CPCs, operating through total internal reflection, and different from the common refracting prisms, have been proposed for although none have made it into commonly available skylight products. For instance, DiTrapani et al US2017/0146204 does describe an array of CPCs in an 'optical system for receiving and collimating light' In particular, the purpose of the limited acceptance angle of the array of CPCs is, as the patent title 'sunlight imitating system' suggests, to limit or narrow the angular spread of the reflected light.

'Skylight with improved low angle light capture' U.S. Pat. No. 8,745,938 by Scheutz et al-Replex Mirror Co. describes a single large form factor CPC that is inverted relative to the direction of incidence of sunlight. This is a hollow CPC with reflective surfaces designed to better capture low angle sun light and this configuration does nothing to improve collection of sunlight from overhead, and distribute it into a wider angular distribution, to wider area of building floor below. 'Method and Apparatus for a Passive Solar Daylighting System' U.S. Pat. No. 6,299,317—Gorthala et al again mentions CPCs but only as a means for the collection and concentration of light such as to optical fibers that can conduct and guide the light to where it is required. We note that although similar design concepts are deployed in luminaires or lighting using LEDs, to provide uniform, comfortable illumination from spatially and angular localized light emitting chips, these, for example US20060203490A1, typically target a 'cut-off' angle to restrict, not broaden, the resulting light distribution.

In summary, all prior art either uses refracting prisms or even if proposing using compound parabolic concentrators or collectors these are deployed, designed into the skylight to concentrate or collimate light, not to cause diffusion or distribution of the light into wider angles to provide illumination to wider occupied areas below.

SUMMARY OF THE INVENTION

The invention is a skylight designed to provide daylighting by directing and distributing sunlight into the interior of a building. The skylight will be comprised of one or more layers that may be configured in a pyramid, dome, hemispherical or polyhedral shape.

These skylight layers will be comprised of a plurality of compound parabolic diffusers, each formed from a transparent material. Each such compound parabolic diffuser—CPD—will have a three-dimensional shape that is defined as the body of revolution of the two-dimensional figure of optics—the compound parabolic concentrator or collector CPC, around an axis of rotation. Each compound parabolic diffuser—CPD—will be defined by an entrance aperture, an exit aperture and height of the parabolic sections between these apertures. Alternately, each CPD, like its CPC analogue, can be defined by an acceptance angle and the entrance aperture or exit aperture diameter. In one embodiment of the invention, the axis of rotation may be the centerline or axis of symmetry of the 2-D CPC. In this embodiment, the plurality of CPDs will be arranged in an array on the skylight layer. The CPDs will be arranged in the layers of the skylight such that their entrance apertures will be positioned substantially towards the exterior of the building and their exit apertures will be positioned substantially towards the interior of the building. In another embodiment of this invention the entrance apertures, or any lateral cross-sections of the CPDs perpendicular to their respective rotation axes, may be polygonal or hexagonal so that they may be arranged on the skylight layer in a polygonal tiling pattern or hexagonal array like a honey-comb. In another embodiment of the invention, where the skylight layer has a circular dome shape, the axis of rotation defining the body of revolution of the CPDs may be chosen to be the axis of cylindrical symmetry of the dome. In this embodiment the CPDs will be disposed as rings or grooves in the skylight layer. The CPDs that comprise the skylight may be formed from any transparent material with refractive index exceeding that of air; examples of such materials including plastics such as acrylic or Plexiglas, poly methyl metha acrylate, polycarbonate or glasses including low-iron glass. Such common materials having a refractive index about 1.5 will define a CPD with ratio of dimensions such that the exit aperture diameter:entrance aperture diameter: height are about 1.25:2.7:3.75.

BRIEF DESCRIPTION OF THE DRAWINGS

Figures provide explanatory details referenced in the following detailed description. Embodiments depicted in the drawings are illustrative but do not limit the scope of the invention as will be evident to those familiar with the art. Reference numbers are provided to indicate correspondence between reference elements.

DETAILED DESCRIPTION OF THE INVENTION

The primary innovation disclosed in this patent is to propose optical structures —compound parabolic diffusers—that when included in functional skylight surfaces or layers provide for more efficient collection and more uniform distribution of the sunlight over a wider building floor area below. The three-dimensional shape of the compound parabolic diffusers is defined as the body of revolution of the more commonly known two-dimensional figure of optics—the compound parabolic concentrator or collector CPC—around a defined axis of rotation. The CPC is well known already in the art for the collection and subsequent concentration or collimation of light but in the present invention their optical properties are used to deflect light from all possible sun angles directing it as if from overhead into a wider angular distribution to floor below. Since the change of direction or deflection of a light ray through the total internal reflection in a CPC is significantly greater than available through refraction CPCs provide an additional advantage over the refractive prisms common in the current art in that they are capable of deflecting light even from oblique angles of the sun directly downwards toward the building floor below.

Figure 4:
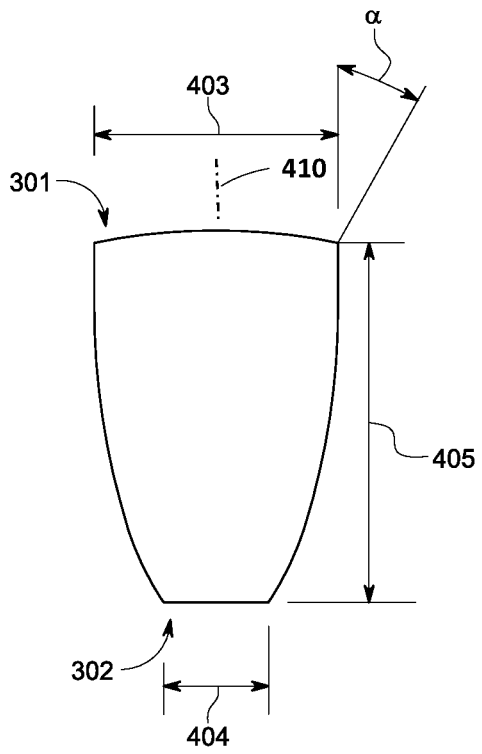
FIG. 4—Detailed view of the 2-D figure of a compound parabolic collector, or cross-section of the compound parabolic diffuser, with acceptance angle $\alpha$ and with diameter 403 of entrance aperture 301, diameter 404 of exit aperture 302 and height 405. The axis of rotation—the centerline axis of symmetry—of the 2-D CPD figure is shown as 410.

Instead of losing light through total internal reflection, as with current refracting prisms, we propose to collect, guide and distribute light more efficiently than available in the current art. With any optical structure or element used for optimal radiative transfer—to collect and transmit light from a source to target—it is recognized that a physical parameter known as etendue, throughput, or phase space volume remains conserved or invariant. From the system point of view, the etendue equals the area of the entrance pupil (or entrance aperture) times the solid angle the source subtends as seen from the pupil or aperture. This presents a simple approach to the problem of maximizing the divergence or solid angle into which the skylight broadcasts the collected sunlight to the building interior. By maximizing the concentration of such rays to a smallest possible area at the exit from the optical structure, this should result, with conservation of throughput, in the widest divergence or solid angle of rays at the exit aperture. This problem has been studied, for the optimizing of collection and concentration of radiation, including solar rays, in the field of non-imaging or anidolic optics as described in *Radiative Transfer*—S. Chandrasekhar (Dover, 1960). A solution described in *High Collection Non-Imaging Optics*—W. T. Welford & R. Winston (Academic Press, New York, 1989)] has been to use compound parabolic concentrators/collectors or CPCs. Compound parabolic concentrators are 3-dimensional structures comprised of the body of revolution generated by the 2-D compound parabola formed from the sections of two parabolas, with each passing through the focus of the other in a common plane. The 2-D cross-section of a compound parabolic diffuser, or its CPC analogue, is shown in FIG. 4, and these are defined by an entrance aperture, an exit aperture and the height of the parabolic sections in between. Alternately, the 2-D cross-section figure of the CPD may be defined by an acceptance angle and the entrance or exit apertures. As with an optical fiber that is ubiquitous in modern telecommunications, if the CPC is filled with a material whose refractive index exceeds ambient air then light rays entering the entrance aperture are reflected on the inner surfaces through total internal reflection—TIR. For a 3-dimensional CPC with a circular lateral cross-section, characterized by an acceptance angle θ, filled with a medium of refractive index n, the maximum theoretical concentration achieved of rays collected at the entrance pupil or aperture is $(n/\sin\theta)^2$—the ratio of the areas of the entrance and the exit apertures; equivalently, for a CPD, this is also the maximum achievable divergence of rays at the exit aperture.

Compound parabolic diffusers, although defined by similar 3-D shape as CPCs here are used here not to collimate or concentrate but to distribute or diffuse light into a wide angular distribution. Further, the total internal reflection is deployed to bend light incident from lower sun angles through a larger deflection angle to provide it as if from overhead to the interior floor below.

By including total internally reflecting CPCs instead of the typical refracting prisms the current invention is able to collect sunlight from a wider range of sun angles and distribute the collected sunlight to a wider area of a building interior below. The current invention makes use not of the convergence of light as it reaches the exit aperture but of the resulting divergence as the light rays leave the exit aperture, and therefore seeks precisely to avoid collimation of light; to not imitate the naturally narrow beam from the Sun, but to disperse, cause significant angular divergence in it, to spread it out to a wider floor area below. The current invention has a plurality of CPC-like structures (Compound Parabolic Diffusers CPDs) which when placed or arranged over a dome or pyramid like surface—the skylight layer—collect light from a wider range of sun angles, from as low as 10° above the horizon to directly overhead, but in all cases, spreading it over a wide area/wide angle to the occupied areas of building below.

Figure 5:
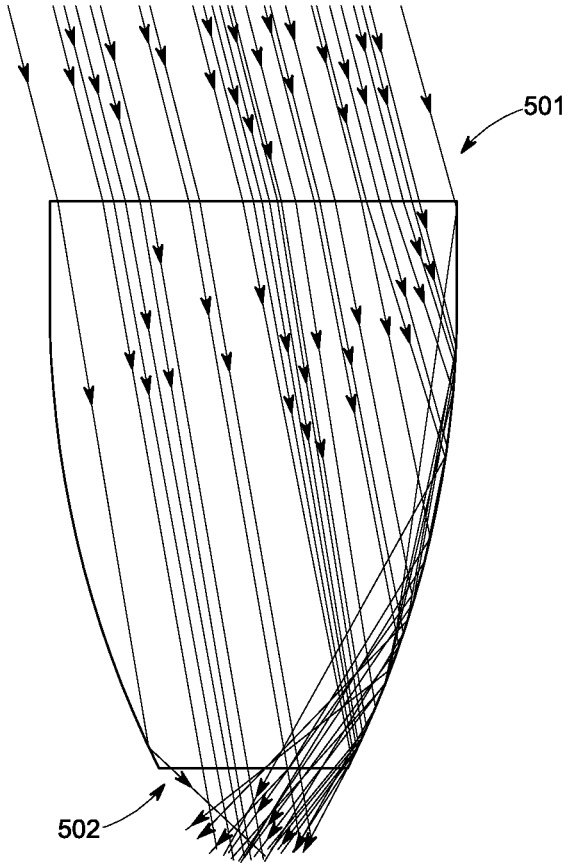
FIG. 5—shows a narrow angle beam of sun light rays 501 incident on the entrance aperture being total internally reflected on the curved surfaces of the compound parabolic diffuser to produce a divergent beam of rays 502 at the exit aperture.

As shown in FIG. 5, when curvature, or slope, is included on the reflecting interface (optical material—air), then the sun's rays, although incident nearly parallel, are reflected into a divergent beam with angles varying according to the variation in slope of the optical material—air (e.g. plastic-air) interface.

Figure 1:
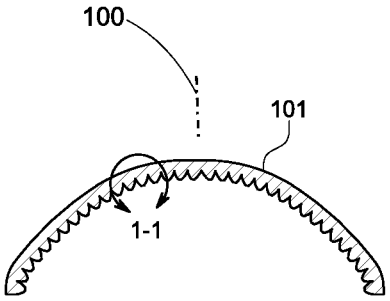
FIG. 1—shows a lateral cross-section of the dome layer 101 in one embodiment of the invention. The axis of rotation—axis of cylindrical symmetry—is shown as 100
Figure 2:
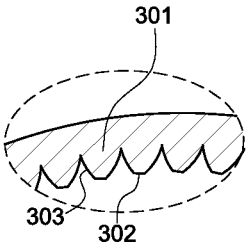
FIG. 2—enlarged cross-section 1-1 of FIG. 1, depicting the cross-section of a compound parabolic diffuser 303 with entrance aperture 301 and exit aperture 302.
Figure 3:
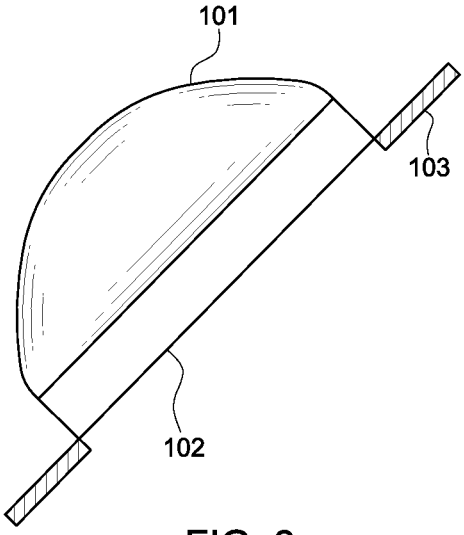
FIG. 3 —depicts a typical skylight that is an embodiment of the invention with dome-shaped layer 101, curb 102, installed on sloped building roof 103.

In one embodiment of the invention, we propose to replace the prisms in typical current skylight layers with compound parabolic diffusers. A lateral cross-section of such a skylight, including such CPD structures into its layer is shown in FIGS. 1 & 2. If the rotation axis of each CPD is chosen as its own symmetry axis or centerline of the 2-D figure FIG. 4 then the CPDs become arranged in an contiguous array in the functional layer of the skylight. A typical embodiment of such a skylight FIG. 3 may have a dome like shape, with a diameter of between 30-100 cm, covering the skylight opening, with CPDs embossed on the layers with dimension ratio of 1.25 mm:2.5 mm:3.75 mm of exit aperture diameter:entrance aperture diameter: height, as in FIG. 4. When formed from a transparent material such as acrylic plastic or polycarbonate or glass with refractive index around 1.5, the CPC analogues of CPD with such dimension ratios provide an acceptance angle of 45°.

Since the skylight in the current invention is able to distribute light over a wider area, it achieves the 'spring afternoon' effect of providing more light over more area with less resultant heat gain. Since the skylight in the current invention also is able to deflect light from low, oblique sun angles to be provided as if from overhead it combines the key features of the ideal skylight—providing comfortable illumination from overhead with little or no heat or glare to the eyes of building occupants below.

Figure 6:
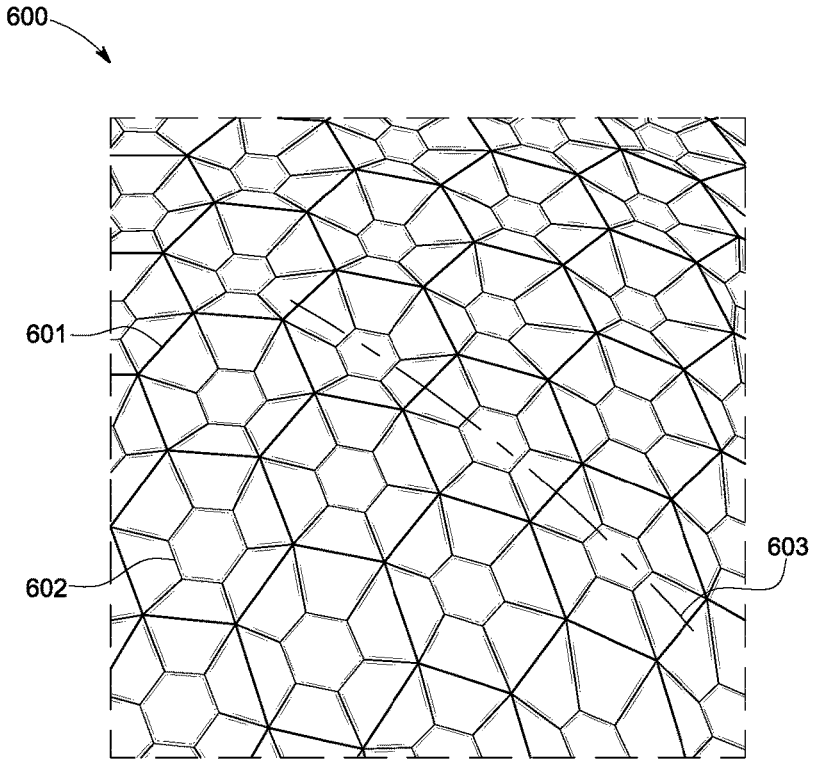
FIG. 6—shows an embodiment of the invention in which the compound parabolic diffusers are arranged in hexagonal or honeycomb like tiling pattern on the dome layer 101 with hexagonal entrance apertures 601 and exit apertures 602. Section view along 603 corresponds to the enlarged cross-section shown in FIG. 2

Since the CPDs in this embodiment are a body of revolution about their own axis of symmetry their cross-section taken laterally, perpendicular to this axis of rotation, will be circular. Circles cannot completely cover or tile the locally planar surface of the dome, hemisphere or polyhedral surface of the skylight. In this case, hexagons, or other polygons may approximate the circular cross-sections of the entrance apertures by having these circles circumscribe each approximating hexagon so that, like a honeycomb, a contiguous arrangement of the CPDs is enabled for complete coverage or tiling of the surface layer of the skylight by the CPDs, as shown in FIG. 6.

Figure 7:
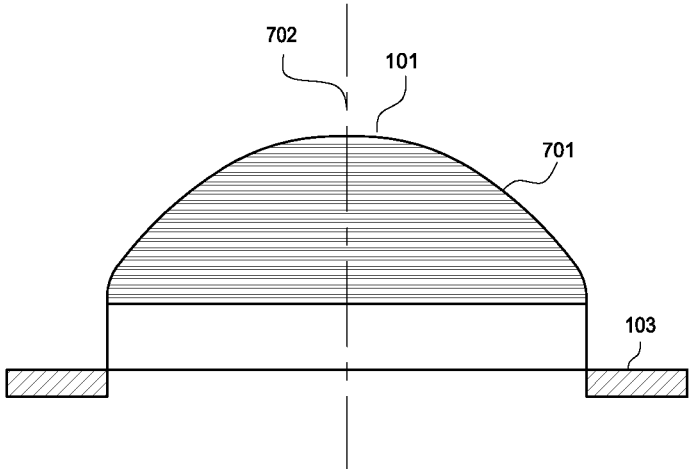
FIG. 7 Shows another embodiment of the invention with the compound parabolic diffuser structures rendered in circumferential grooves 701 in the skylight dome layer 101 with the section 702 also being depicted by FIG. 1. The shape of this embodiment may be generated as the body of revolution of the 2-D FIG. 1 about the central dome rotation axis 100.

In another embodiment of the invention, the CPDs may rendered in circumferential rings or grooves in skylights with cylindrical or axisymmetry, as shown in FIG. 7, with their cross-section being depicted by FIG. 1. In this embodiment, each CPD is the body of revolution of the 2-D CPC (FIG. 4) about the axis of cylindrical symmetry or body axis of the skylight, shown as 100 in FIG. 1.

Figure 8:
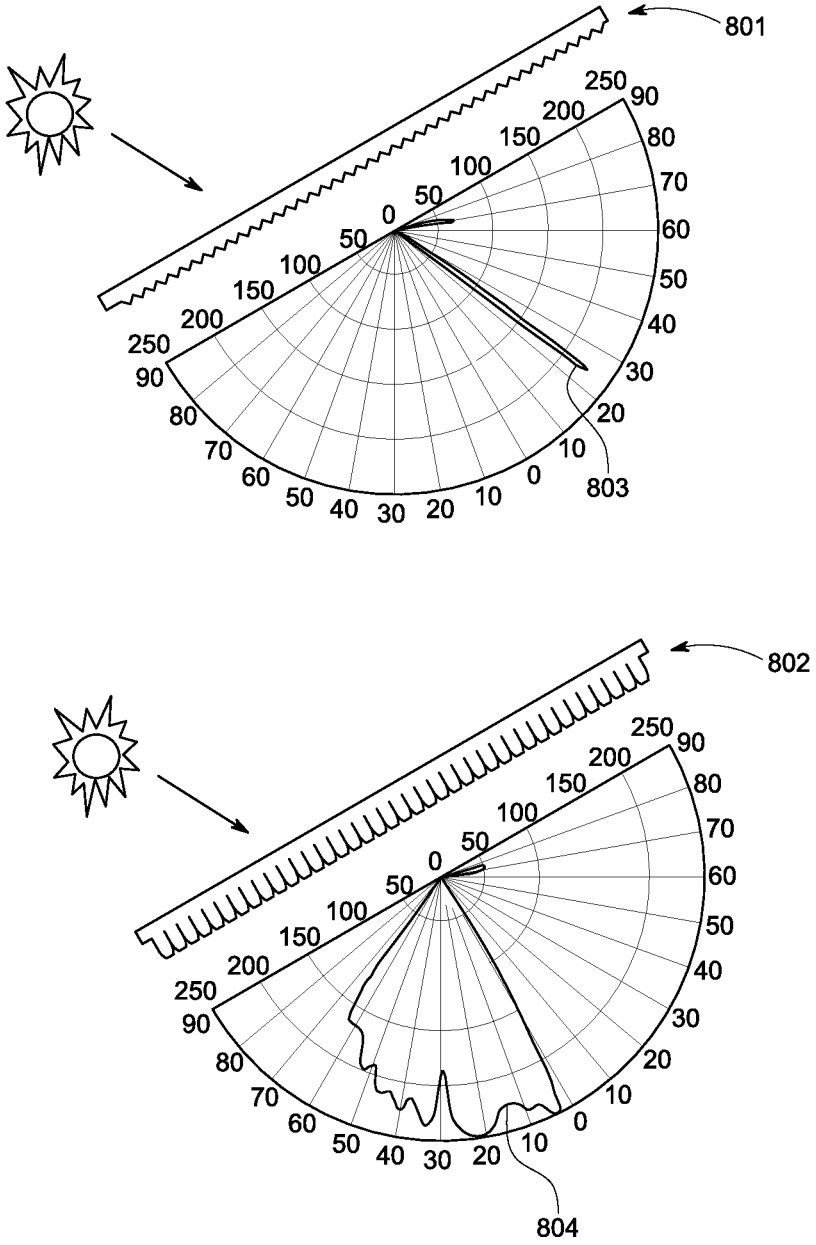
FIG. 8 shows the result of an optical simulations showing sunlight incident from a oblique angle (10° above horizontal horizon) onto a section of a skylight layer at a (typical) slope of 30° to horizontal. The resulting light distribution 803 from typical skylight 801 with typical refracting prisms is very narrow, leading to glare, while the same incident sun rays on a skylight layer with CPDs 802 results in a much broader angular distribution of day lighting 804 provided to wider area below. Thus the current invention is able to provide the ideal skylight function of providing light from overhead into a wide angle distribution for glare-free comfort below.

FIG. 8 summarizes the advantage of this invention—modeling the result of optical simulations with sunlight incident from an oblique sun angle—10° above horizontal horizon—onto a section of a skylight layer at a typical slope of 30° to horizontal. The resulting light distribution 803 from typical skylight 801 with typical refracting prisms is very narrow, leading to glare, while the same incident sun rays on a skylight layer with CPCs 802 results in a much broader angular distribution of day lighting 804 provided to wider area below. Thus the current invention is able to provide the ideal skylight function of collecting light from even oblique angles of the sun while providing day lighting from overhead into a broad angle distribution for glare-free, comfortable illumination of a wide area of building interior below. Similar to current prism structures, these compound parabolic diffuser structures may be rendered in polycarbonate or acrylic plastic, also known by the trademark Plexiglas or by the chemical name poly methyl metha acrylate (PMMA). Acrylic plastics are low-cost, and have been used in rugged applications such as combat aircraft windows in the Second World War and, since they are proven sun UV resistant for years, also used widely in building construction, including in current skylights, greenhouses and pavilions. Although these plastics absorb solar UV radiation, visible light is transmitted with high efficiency, of up to 92%.

Also significant is that such transparent plastics can be easily molded into the desired form factors including skylight panels—through injection molding, casting or extrusion—in manufacturing techniques known, for example, Jungbecker of Germany or K S Manufacturing/Henry Plastics of San Leandro, Calif. The appropriate grades of sun UV resistant plastic are available in pellet form from common acrylic raw suppliers such as Evonik.

Our skylight design may include more than one layer with such CPD structures, like many 'double-glazed' skylights or double-pane windows—one of which, designated the first or outer layer, with upper side facing the sun outside, and a second or inner layer below with lower side facing the building floor. The gap between the inner and outer layers of the skylight can function to collect air heated by the sunlight in or from near the ceiling of the building that anyway absorbs most of the solar heat that is incident upon the building roof. The advantage provided is that this heat may be vented easily, similar to many current skylights, or the heat kept inside for passive solar heating during cooler months. The skylight layers or panels comprising these layers including the compound parabolic diffuser CPD structures may also be placed on top of a light tube or other tubular daylighting device (TDD).

The exit apertures of the CPDs may be provided with texturing, roughening or other means of diffusing the light rays further.

SUMMARY

A skylight to provide daylighting to building interiors is described that includes a plurality of compound parabolic diffusers into one or more layers that may be dome or pyramid-shaped to enable more efficient collection of sunlight and its distribution through wider angles over wider areas of floor below resulting in more comfortable illumination with less glare and heat gain.

What is claimed is:

1. A skylight configured to direct and distribute sunlight into the interior of a building;

said skylight including at least one layer comprised of a plurality of compound parabolic diffusers;

each said compound parabolic diffuser formed from a transparent material;

each said compound parabolic diffuser being associated with an axis of rotation;

each said compound parabolic diffuser being defined as the three-dimensional body of revolution of a compound parabolic collector around said axis of rotation;

each said compound parabolic collector being a two-dimensional figure defined by an entrance aperture, an exit aperture, a height of the parabolic sections in between said apertures and a centerline axis of symmetry;

wherein each said compound parabolic diffuser having its entrance aperture substantially positioned towards the exterior of building and its exit aperture substantially positioned towards the interior of the building.

2. The skylight of claim 1 with said axis of rotation of each compound parabolic diffuser being the centerline axis of symmetry of the compound parabolic collector.

3. The skylight of claim 1 with said layer being in the form of a hemisphere or dome;

said hemisphere or dome defined by an axis of cylindrical symmetry.

4. The skylight of claim 1 with said axis of rotation of each compound parabolic diffuser being the axis of cylindrical symmetry of claim 3.

5. The skylight of claim 1 with said layer being in the form of pyramid or a polyhedron.

6. The skylight of claim 1 with said transparent material being chosen from the class including plastics such as acrylic, poly methyl metha acrylate, polycarbonate or from the class of glasses including tempered low-iron glass.

7. The skylight of claim 2 or 5 with each said compound parabolic diffuser having an entrance aperture that circumscribes a hexagonal figure whereby the plurality of compound parabolic diffusers are arranged contiguously to tile the layer of the skylight in a honeycomb pattern.

8. The skylight of claim 1 wherein the said compound parabolic diffusers are formed from a transparent material having a refractive index of about 1.5 and having a height such that the ratio exit aperture diameter:entrance aperture diameter: height are about 1.25:2.7:3.75.

* * * * *